United States Patent [19]

Osborne et al.

[11] 4,302,646

[45] Nov. 24, 1981

[54] ELECTRIC SWITCH AND OPERATING MECHANISM THEREFOR

[75] Inventors: Anthony Osborne, Duluth; Kenneth E. Hanke, Atlanta, both of Ga.

[73] Assignee: Kearney-National Inc., Atlanta, Ga.

[21] Appl. No.: 111,913

[22] Filed: Jan. 14, 1980

[51] Int. Cl.[3] ..... H01H 3/30; H01H 9/22; H01H 31/06

[52] U.S. Cl. ..... 200/153 SC; 200/48 KB; 200/318

[58] Field of Search ..... 200/318, 153 SC, 154, 200/162, 321, 322, 325, 67 C, 68, 153 G, 336, 153 H, 48 KB

[56] References Cited

U.S. PATENT DOCUMENTS

| | | | |
|---|---|---|---|
| 3,470,750 | 10/1969 | Wetter | 200/153 SC |
| 3,790,731 | 2/1974 | Date | 200/153 SC |
| 3,876,847 | 4/1975 | Dykes et al. | 200/153 SC |
| 4,139,747 | 2/1979 | Kelly et al. | 200/48 KB |

*Primary Examiner*—Willis Little
*Attorney, Agent, or Firm*—Rodgers & Rodgers

[57] ABSTRACT

An electric switch of the snap-action type includes a pair of relatively movable contacts, an operating linkage interconnected with a movable one of the contacts for imparting operating movement thereto, a hollow tubular rotatable member interconnected with the operating linkage and operable to impart switch operating movement thereto, a latching part secured to the rotatable member and engageable with abutment means so as to secure the rotatable member against rotation, spring means in the form of a torsion bar disposed within the rotatable member and effective to impart rotation thereto upon disengagement of the latching part from the abutment means, movable motive means in the form of a rotatable tube interconnected with the torsion bar for imparting twisting moment thereto together with latch releasing means mounted on and movable with the movable motive means for engaging the latching part and for moving such part out of engagement with the associated fixed abutment means after a predetermined degree of twisting moment is imparted to the torsion bar.

18 Claims, 9 Drawing Figures

ELECTRIC SWITCH AND OPERATING MECHANISM THEREFOR

TECHNICAL FIELD

This invention relates to electric switches for use in connection with electric power switching systems.

BACKGROUND ART

Known power switching equipment utilizes a large number of parts some of which are disposed within large open enclosing structures and which may involve the use of several switch operating springs. Such devices are subject to contamination by moisture and by foreign particles from atmosphere and may become so encrusted with pollutants that operation of the relatively movable parts becomes impossible.

U.S. Pat. No. 3,190,983 is representative of a so-called snap-action type switch which includes a great number of parts and which is characterized by a high degree of complication. While a switch constructed according to U.S. Pat. No. 3,190,983 is capable of fast action, it is necessary to initiate an operation of the switch by some special means such as electromagnetic means or thermally responsive means. Of course such specialized actuating devices require substantial maintenance and are expensive as well as complicated when used as a part of a switch operating mechanism.

DISCLOSURE OF INVENTION

An electric switch constructed according to this invention is compact in construction and requires few parts. Housing structure for the switch parts contributes to long and satisfactory service due in part to the substantial elimination of corrosion and other contamination of the parts from atmosphere. An electric switch constructed according to this invention in one form includes one or more movable contacts mounted on a supporting structure and provided with an operating linkage which controls movement of a movable contact and which in turn is operated by a rotatable member in the form of a hollow tubular element a part of which is disposed within a housing structure and to which the latching part of latch means is secured. This latching part is arranged to cooperate with fixed abutments disposed within the housing and arranged when engaged by the latching part to secure the rotatable member against rotation. By this means the rotatable member is secured in either a switch closed position or a switch opened position. Spring means preferably in the form of a torsion bar is disposed within the rotatable member and secured at one end to the corresponding end of the rotatable member. The torsion bar is twisted by movable motive means in the form of a rotatable tube which engages the opposite end of the torsion bar and latch releasing means in the form of a rotatable cam finger is mounted on the rotatable tube and disposed within the housing and is arranged to engage the latching part and to move such part out of engagement with its associated fixed abutment after the rotatable tube has imparted a predetermined degree of energization to the torsion bar so as to insure quick opening or quick closing of the switch contacts depending upon the direction of twisting moment imparted to the torsion bar and upon the particular abutment means which is in engagement with the latching part.

BEST MODE OF CARRYING OUT THE INVENTION

Figure 1:
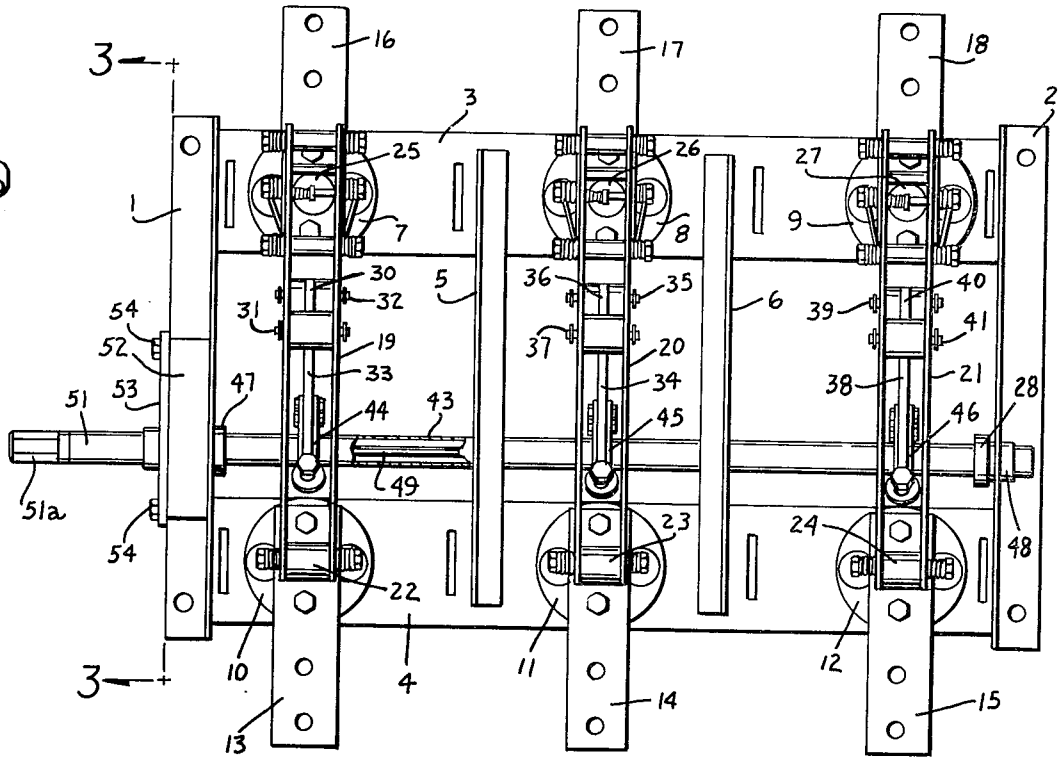
FIG. 1 is a front view of a three phase power switch constructed according to this invention.
Figure 2:
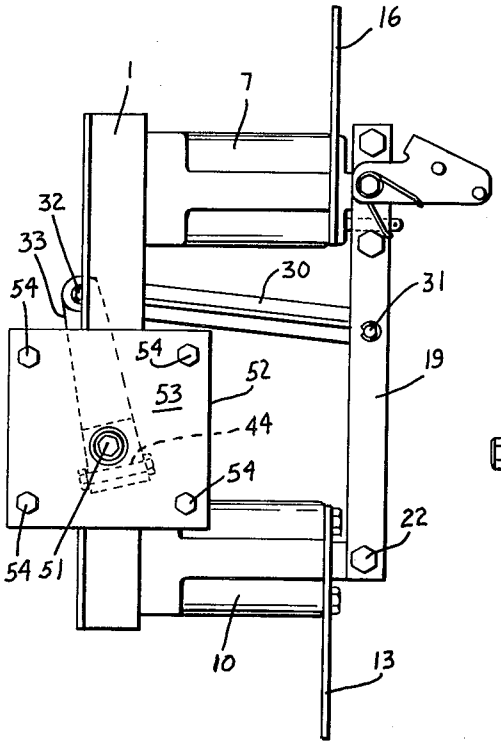
FIG. 2 is an end view of the mechanism shown in FIG. 1.
Figure 9:
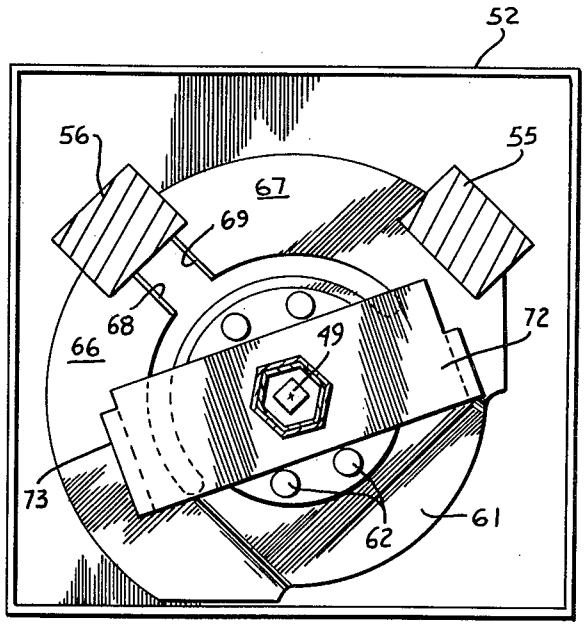
FIG. 9 is a view generally along the line designated 9—9 in FIG. 8.
Figure 4:
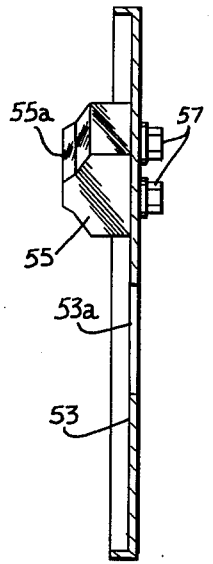
FIG. 4 is a cross sectional view taken along the line designated 4—4 in FIG. 3.
Figure 3:
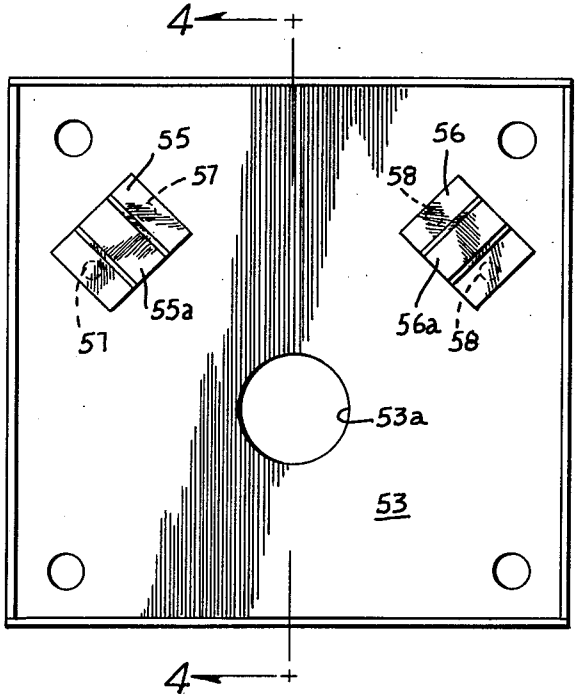
FIG. 3 is a view taken along the line designated 3—3 in FIG. 1 and represents the inside face of the cover of the housing mechanism.

With reference to FIGS. 1 and 2, the numerals 1 and 2 designate a pair of outer support elements to the ends of which a pair of cross supports 3 and 4 are secured by any suitable means. Intermediate supports 5 and 6 are secured at their ends to the cross supports 3 and 4. Mounted on and supported by the cross member 3 are switch supporting insulators 7, 8 and 9 while insulators 10, 11 and 12 are mounted on cross support element 4. Terminals 13, 14 and 15 are mounted to and supported by the insulators 10, 11 and 12 respectively while terminals 16, 17 and 18 are mounted on and supported by insulators 7, 8 and 9 respectively. Switch blades 19, 20 and 21 are pivotally mounted at pivots 22, 23 and 24 respectively and switches 19–21 cooperate respectively with fixed contacts 25, 26 and 27 mounted on insulators 7, 8 and 9 and electrically connected with terminals 16, 17 and 18 respectively.

For the purpose of imparting operating movement to blade 19 to the closed or open position, an operating linkage includes a link 30 pivotally connected at 31 to switch blade 19 and pivotally connected at 32 to crank 33. Switch blade 20 is operated by a crank 34 pivotally connected at 35 with a link 36 which in turn is pivoted at 37 to blade 20. In like fashion blade 21 is operated by a crank 38 pivoted at 39 to a link 40 pivoted at 41 to blade 21.

As is apparent from FIGS. 1 and 2 switch blades 19, 20 and 21 are operated simultaneously by simultaneous cranking movement of cranks 33, 34 and 38. These cranks are secured to rotatable member 43 by suitable clamping structures 44, 45 and 46 so that rotation of rotatable member 43 within its bearings 47 and 48 imparts simultaneous opening or closing movement to the switch blades 19, 20 and 21. As is apparent from FIG. 1, a collar 28 is disposed about rotatable member 43. This collar is secured to member 43 and engages support structure 2 and prevents axial movement of element 43 toward the right.

Figure 8:
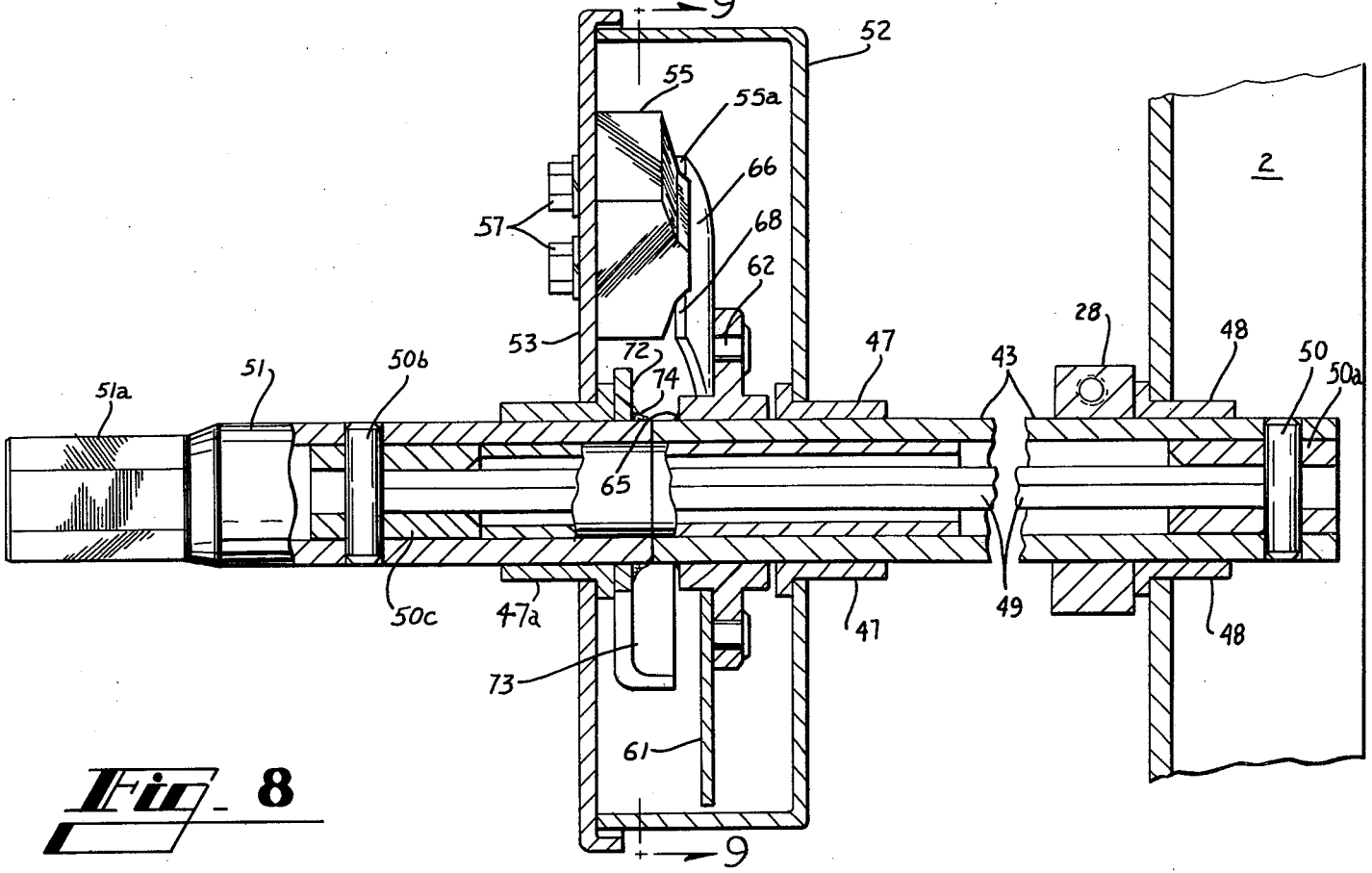
FIG. 8 is an enlarged view partially in section of a part of the switch operating mechanism in closed position.

Operation of rotatable member 43 is effected by means of a torsion bar 49 which is square in cross section and disposed within the hollow tubular rotatable member 43 and secured at one end to rotatable member 43 by a pin 50 and sleeve 50*a* as best shown in FIG. 8. Rotatable tube 51 is operably related in similar fashion by the pin 50*b* and sleeve 50*c* with the left hand end of torsion bar 49 as viewed in FIG. 1. Rotation of rotatable tube 51 imparts twisting action to torsion bar 49. The rotatable element 43 is normally locked in either the switch open or switch closed position by mechanism disposed within housing structure 52 mounted on and supported by support element 1. Housing 52 includes a cover 53 secured to the body of the housing by bolts 54.

Figure 6:
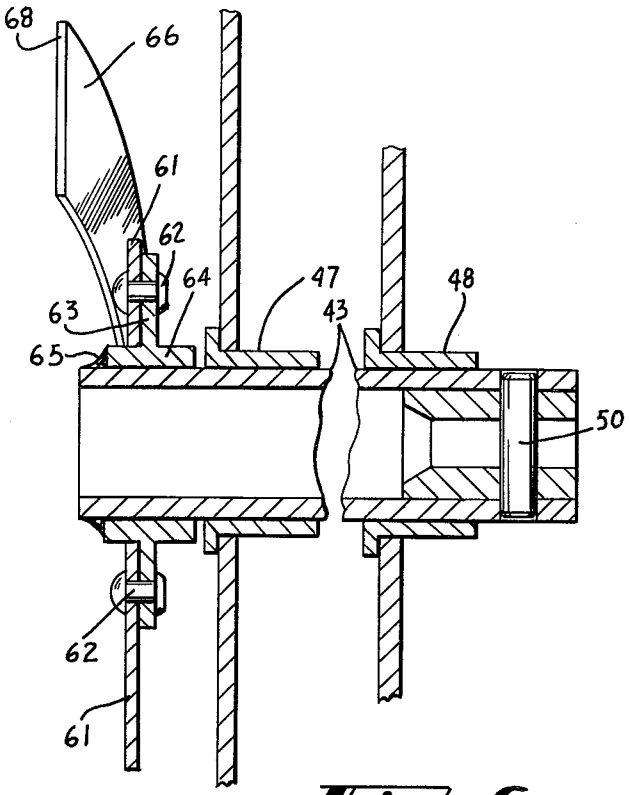
FIG. 6 is a view taken along the line designated 6—6 in FIG. 5.
Figure 5:
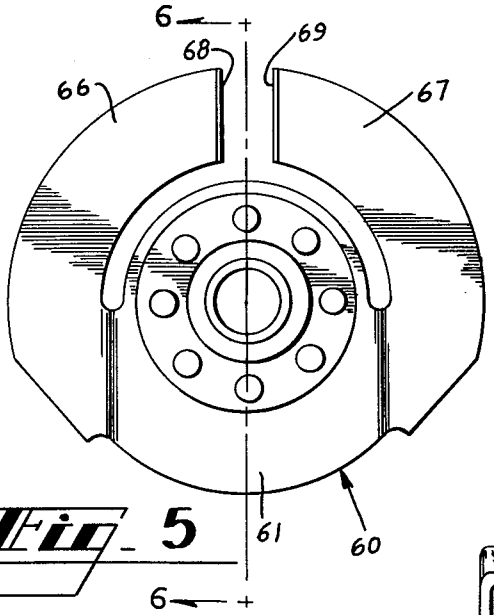
FIG. 5 is a view of the latching part of the latch means.

Mechanism disposed within housing 52 includes latching means which comprises a pair of fixed abutments 55 and 56 secured by bolts 57 and 58 to the inside surface to cover 53 together with a latching part 60 best shown in FIGS. 3, 4, 5 and 6. Latching part 60 is rigidly secured to rotatable member 43 as is best shown in FIGS. 5 and 6 and includes a hub portion 61 secured by rivets 62 to the flange 63 of a sleeve 64 which sleeve is secured by a pressed fit and by welding indicated at 65 to the outer periphery of rotatable member 43. As is shown in FIGS. 5 and 6, latching part 60 also includes a pair of peripheral segments 66 and 67 having peripherally spaced parts 68 and 69 which define a space therebetween.

As is apparent from FIG. 6 peripheral segment 66 is warped generally toward the left and in a direction which is longitudinal with respect to the rotatable member 43. Peripheral segment 67 is similarly warped and thus extends toward the left as this part would be viewed in FIG. 6 although peripheral segment 67 does not appear in FIG. 6. When the switch is closed, the peripheral segments 66 and 67 are disposed in enveloping relation to the upraised center portion 55*a* of abutment 55 and thus secure the switch against opening movement.

For imparting opening movement to the switch blades 19, 20 and 21, twisting moment is imparted to torsion bar 49 in a clockwise direction as viewed in FIG. 2. This twisting moment is effected by means of a suitable tool such as a hand crank (not shown) which engages the socket portion 51*a* of rotatable tube 51 so that clockwise rotation of such crank (not shown) imparts clockwise rotation to rotatable tube 51 as viewed in FIG. 2. Rotation of rotatable tube 51 continues until a sufficient twist is established in torsion bar 49 to effect a quick snap-action opening of all of the switch blades 19, 20 and 21 after these blades are unlatched.

For releasing the blades 19, 20 and 21 for opening movement, it is necessary to move the peripheral segments 66 of latching part 60 in a direction toward the right as viewed for example in FIGS. 1 and 6 so as to allow the peripheral segment 66 to ride over the center portion 55*a* of fixed abutment 55. Once this action takes place, the rotatable member 43 is released and is then free to rotate and thereby to swing the blades 19, 20 and 21 in a clockwise direction as viewed in FIG. 2 and out of contact with the fixed contacts 25, 26 and 27.

Figure 7:
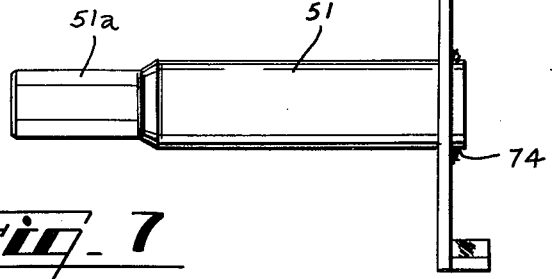
FIG. 7 is an enlarged view of a portion of the mechanism shown in part in FIG. 1.

In order to effect releasing movement toward the right of latching part 66, latch releasing means is provided and comprises rotatable cam finger 72 and its end part 73 as best shown in FIGS. 7 and 8. Cam finger 72 is secured to and rotatable with the movable motive means in the form of rotatable tube 51 as indicated by welding at 74. As is apparent in FIG. 8 cam finger 72 has biased peripheral segment 66 toward the right and in a longitudinal direction relative to rotatable member 43 so that the high center portion 55*a* of fixed abutment 55 is no longer in a position of engagement with the peripheral segment 66. Under these conditions, the rotatable element 43 under the biasing action of torsion bar 49 is free to rotate in a clockwise direction as viewed in FIG. 2. This rotation of course swings the blades 19, 20 and 21 in a clockwise direction as viewed in FIG. 2 and into open circuit condition. This opening movement of the mechanism causes peripheral segment 67 of the latching part 60 to ride up and over the high center part 56*a* of fixed abutment 56 and causes that high center part 56*a* to occupy a position between the adjacent peripherally spaced end portions 68 and 69 of the latching part 60. Under these conditions the switch mechanism is clamped in the open position. Of course it will be understood that release of the latching parts from the fixed abutment means 55 due to the action of the latch releasing means 72 is arranged so that adequate torsion moment has already been built up in torsion bar 49 so as to effect a rapid snap-action opening movement of the switch blades 19, 20 and 21 at the instant when the peripheral segment 66 disengages the high center part 55*a* of the fixed abutment 55.

In order to close the switch with snap action, it is simply necessary to apply the hand tool (not shown in the drawings) to the end portion 51*a* of the rotatable tube 51 and to rotate that tube in a counterclockwise direction as viewed in FIG. 2. This action establishes a torsion moment in the torsion bar 49 and after predetermined rotation of rotatable tube 51 causes the peripheral segment 67 to move in a direction generally toward the right with reference to FIGS. 1 and 6 and out of engagement with the upraised center portion 56*a* of the fixed abutment 56. The built up moment in torsion bar 49 then effects a snap-action closing movement of the switch blades 19, 20 and 21.

If the blades 19, 20 and 21 are frozen and are incapable of proper opening as described above due for example to corrosion, pitting of the contact surfaces or to partial welding caused by arcing, the mechanism can be operated by continued rotation of rotatable tube 51 which causes the latch finger 73 to engage the peripheral part 69 of peripheral segment 67 and then to force rotation of rotatable member 43 and in turn to move cranks such as 33, 34, 38 and links such as 30, 36, 40 which movement swings the blades such as 19, 20, 21 to open positions.

From the above description it is apparent that the operating mechanism and switch formed according to this invention comprise a small number of operating parts. Furthermore from FIG. 8 it is apparent that the operating mechanism including the fixed abutments such as 55 and 56, the peripheral segments such as 66 and 67 as well as the latch releasing means 72 are all disposed within the housing structure 52 so that these moving parts which cooperate with each other are fully protected from corrosion and other damage due to the accumulation of foreign matter from atmosphere. Also it is apparent that the torsion bar 49 is also fully enclosed since this bar is disposed inside the rotatable member 43 and its cooperation with the rotatable tube 51 is completely protected since the tube 51 extends through the opening 53*a* in the cover 53 of the housing structure 52. Furthermore since the rotatable element 43 is freely rotatable in its bearings 47 and 48, it is apparent that the mechanism is also characterized by minimum friction and this factor further enhances the snap-action operation of the movable parts.

INDUSTRIAL APPLICABILITY

The operating mechanism and switch formed according to this invention are well suited for use in distribution systems and particularly in underground distribution systems serving subdivision, shopping centers, industrial parks having both loop and radial feed. The invention is particularly well suited for use where there is a substantial degree of air pollution due for example to the nearness of gas evolving industrial plants, commercial establishments and the like. The mechanism and switch are particularly well adapted also for use in coastal areas where nearness to contaminating salt water poses a hazard to the mechanism. Also a switch constructed according to this invention is well suited for use in environments characterized by high humidity.

We claim:

1. An electric switch comprising a pair of relatively movable contacts, an operating linkage interconnected with a movable one of said contacts for imparting operating movement thereto, a hollow rotatable member directly interconnected with said operating linkage and operable to impart operating movement thereto, latch means including a latching part directly secured to said rotatable member and normally effective to secure said rotatable member against rotation, a torsion bar disposed within said hollow rotatable member and interconnected with said rotatable member at one end thereof and effective to impart rotation thereto upon release of said latch means, rotatable motive means operably related with said torsion bar at the other end thereof for twisting and energizing said torsion bar, and latch releasing means operable in coordination with movement of said rotatable motive means for releasing said latch means after a predetermined degree of twisting and energization of said torsion bar.

2. A switch according to claim 1 wherein said latch means includes a fixed abutment element engageable by said latching part so as to secure said hollow rotatable member against rotation.

3. A switch according to claim 1 wherein said latch means includes a pair of spaced fixedly mounted abutments and wherein said latching part includes a pair of spaced segments for engaging said abutments.

4. A switch according to claim 3 wherein one of said abutments is arranged to engage said latching part so as to hold said rotatable member in a switch closed position and the other of said abutments is arranged to engage said latching part so as to hold said rotatable member in a switch open position.

5. A switch according to claim 1 wherein said rotatable motive means comprises a rotatable tube connected with the other end of said torsion bar.

6. A switch according to claim 5 wherein said latch releasing means comprises a cam finger secured to said rotatable tube.

7. A switch according to claim 1 wherein said latch releasing means comprises cam means mounted on and movable with said rotatable motive means.

8. A switch according to claim 7 wherein said cam means and a part of said movable motive means are disposed within a housing structure.

9. A switch according to claim 1 wherein said latch means and a part of said rotatable member are disposed within a housing structure.

10. An electric switch comprising a pair of relatively movable contacts an operating linkage interconnected with a movable one of said contacts for imparting operating movement thereto, a rotatable member interconnected with said operating linkage and operable to impart operating movement thereto, movable motive means for rotating said rotatable shaft, latch means including a pair of latching parts secured to said rotatable member and effective to secure said rotatable member against rotation from switch closed and switch open positions respectively, latch releasing means carried by said movable motive means and operable in coordination with movement thereof for releasing the one of said latching parts which latches said rotatable member in switch closed position and for engaging the other of said latching parts and for moving said other latching part and said rotatable member from switch closed to switch open positions in the event that said contacts are frozen in closed position.

11. An operating mechanism for an electric switch having a movable contact, said mechanism comprising housing structure, a hollow rotatable member interconnected with said movable contact for imparting operating movement thereto and having a part disposed within said housing structure, a torsion bar disposed within said rotatable member and having a part disposed within said housing and being arranged to bias said rotatable member for rotation in opposite directions, a rotatable tube having a part disposed within said housing structure and arranged to rotate said torsion bar, and latch means including a latching part secured to said hollow rotatable member and disposed within said housing structure and a pair of spaced abutments fixedly mounted within said housing structure and engageable by said latching part during switch open and switch closed conditions respectively.

12. A mechanism according to claim 11 wherein latch releasing means is mounted on and movable with said rotatable tube and disposed within said housing structure and engageable with said latching part in coordination with predetermined rotation of said rotatable tube.

13. A mechanism according to claim 11 wherein a supporting structure is provided for said mechanism and wherein a collar is disposed about and affixed to said rotatable member and engageable with a part of said supporting structure for preventing movement in one axial direction of said rotatable member relative to said supporting structure.

14. An electric switch comprising a pair of relatively movable contacts, an operating linkage interconnected with a movable one of said contacts for imparting operating movement thereto, a rotatable member interconnected with said operating linkage and operable to impart operating movement thereto, latch means including a latching part having a hub portion secured to said rotatable member and a pair of peripheral segments having peripherally spaced parts which are warped in a direction longitudinally of said rotatable member and normally effective to secure said rotatable member against rotation, spring means interconnected with said rotatable member and effective to impart rotation thereto upon release of said latch means, movable motive means operably related with said spring means for energizing said spring means, and latch releasing means operable in coordination with movement of said movable motive means for releasing said latch means after a predetermined degree of energization of said spring means.

15. A switch according to claim 14 wherein a fixed abutment is disposed for envelopment beween said peripherally spaced parts of said peripheral segments.

16. A switch according to claim 15 wherein a rotatable cam finger is engageable with one of said peripheral segments and effective to impart latch releasing movement thereto in a direction longitudinally of said rotatable member.

17. A switch according to claim 16 wherein said latch releasing movement of one of said peripheral segments is in a direction opposite to the direction in which such segment is warped.

18. A switch according to claim 14 wherein a pair of spaced fixed abutments are arranged for envelopment between said peripherally spaced parts of said latching part during switch open and switch closed positions respectively.

* * * * *